US006076591A

United States Patent [19]

Bergamaschi

[11] Patent Number: 6,076,591

[45] Date of Patent: Jun. 20, 2000

[54] LOCKING DEVICE FOR CURTAINS, AWNINGS AND THE LIKE

[75] Inventor: Giovanni Bergamaschi, Bologna, Italy

[73] Assignee: Sunproject S.r.l., Cadriano Di Granarolo, Israel

[21] Appl. No.: 09/194,228

[22] PCT Filed: May 20, 1997

[86] PCT No.: PCT/IB97/00572

§ 371 Date: Nov. 23, 1998

§ 102(e) Date: Nov. 23, 1998

[87] PCT Pub. No.: WO97/44563

PCT Pub. Date: Nov. 27, 1997

[30] Foreign Application Priority Data

May 23, 1996 [IT] Italy ..... BO96A0283

[51] Int. Cl.[7] ..... E06B 9/56

[52] U.S. Cl. ..... 160/298; 160/307

[58] Field of Search ..... 160/307, 298, 160/299, 291, 296

[56] References Cited

U.S. PATENT DOCUMENTS 1,841,384 1/1932 Schmeltz .
5,443,109 8/1995 Benthin ..... 160/298
5,482,105 1/1996 Rude ..... 160/307
5,488,983 2/1996 Jung ..... 160/298

FOREIGN PATENT DOCUMENTS

WO 91/03619 3/1991 WIPO .
WO 94/15057 7/1994 WIPO .

*Primary Examiner*—David M. Purol
*Attorney, Agent, or Firm*—Nims, Howes, Collison, Hansen & Lackert; William J. Sapone, Esq.

[57] ABSTRACT

An assembly for locking a curtain in a selected position has a hollow roller unto which a curtain is rolled and unrolled, the roller containing an elastic winding device, and a locking device for locking the roller in the selected position. The locking device has a support coupled to the roller, the support having a cavity which receives co-axially and rotatably at least one locking element that has an elastic band which frictionally engages the support to hinder free rotation of the roller. The elastic band has a first end fastened to the locking element with the band wound around the locking element so that the band is in frictional contact with the support. Turning the roller in the curtain unrolling direction stretches the elastic band thus reducing the band diameter and reducing friction while turning the roller in the curtain rolling up direction in response to the elastic rewinding device increases the band diameter and increases friction so as to overcome the rewinding action and lock the curtain in the selected position.

4 Claims, 2 Drawing Sheets

FIG. 2
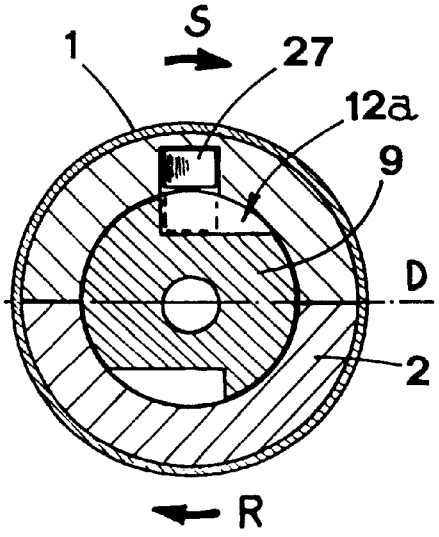
Prior art
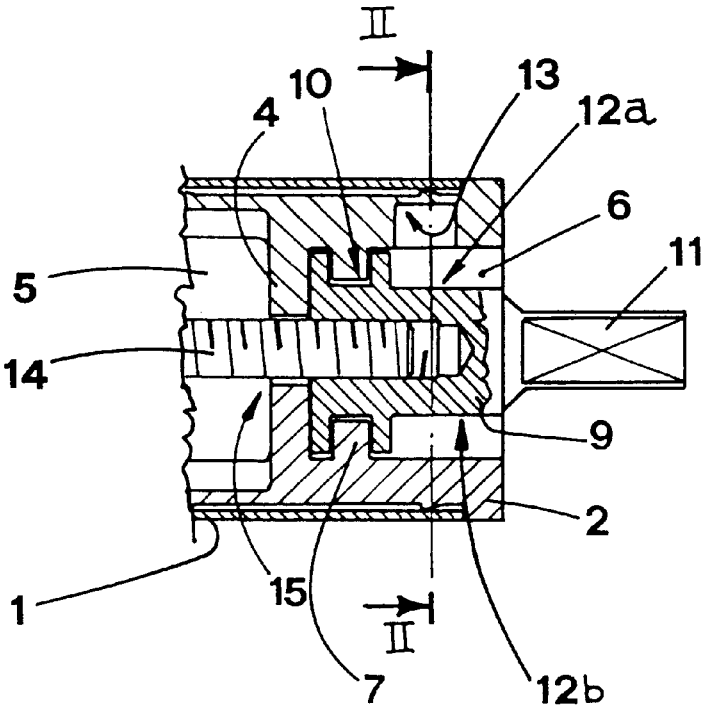
FIG. 1
Prior art

LOCKING DEVICE FOR CURTAINS, AWNINGS AND THE LIKE

BACKGROUND OF THE INVENTION

The present invention concerns production of apparatuses, which are applied to windows or doors generally for dimming or protection, such as awnings or mosquito curtains rolling on and unrolling from a roller.

In particular, the present invention refers to a device for locking these apparatuses in a desired position, usually open or close, but also in any intermediate position.

DESCRIPTION OF THE PRIOR ART

It is known that these apparatuses usually include a roller, on which the curtain (or net in case of mosquito curtain) rolls up, supported horizontally by suitable means inside a corresponding case, called a rolling box, situated over the window or door, near its upper edge.

The free extremity of the curtain goes out of the rolling box through a slit turned downwards. In this way, it is possible to unroll the curtain from the roller by pulling it downward.

The curtain is then rolled again on the roller by elastic means, generally including a spring, situated inside the roller, and whose elastic constant is such that the curtain withdraws when released.

Significant improvements to these means have been described in other patent applications, filed by the same Applicant.

The curtain can also be operated by suitable control means, equipped with a pulley, integral with the roller and joined to a string.

Two extremities of the string go out from the pulley, and therefore from the apparatus support, on its opposite ends, laterally and vertically with respect to the curtain.

Downward pulling of one of the string ends provokes rotation of the roller in the re-rolling direction, while downward pulling of the other string end provokes its rotation in the curtain unrolling direction.

Suitable locking means, usually joined with the roller, allow to position the curtain approximately in the desired point.

Rotation resistance of these means must not be significant while the curtain is moving, both in rolling and unrolling directions, but must be sufficient to keep it in position when it is motionless, possibly overcoming the action of the above mentioned elastic means, which would tend to re-roll the curtain.

An apparatus of the aforementioned type is disclosed in the Italian Patent no. 1.234.071, granted to the same Applicant.

The locking means of the apparatus realized according to this patent allow to fix the curtain position in a quite simple and reliable way.

The technical solutions described therein will be now briefly illustrated with reference to the FIGS. 1 and 2 of the enclosed drawings, in which:

FIG. 1 is a section view of a head of the apparatus containing the locking means, and FIG. 2 is a section view taken along the line II–II of FIG. 1.

In these figures the roller, which accommodates a curtain (or a net or something else) rolled thereon, is indicated with numeral 1.

One head of the roller 1, which is hollow, is closed by a cap 2 which is introduced inside the roller for a predetermined length.

The two opposite heads of the cap 2 feature cavities 5, 6, respectively internal and external with respect to the roller 1.

Near its bottom, the external cavity 6 is provided with an elevated edge defining a collar 7.

In the central position of the wall 4, dividing the two cavities 5, 6, there is made a through hole 15.

A substantially cylindrical support element 9, situated inside the external cavity 6, features a groove 10 made near its internal extremity and complementary to the collar 7, with which it engages.

One end of a bar 14, aimed at e.g. supporting curtain rewinding elastic means, is fastened to the element 9, coaxially with the roller 1, as described in a more precise way in the aforementioned patent no. 1.234.071.

The head of the support element 9, external with respect to the cavity 6, extends so as to define a tang 11, which allows to support the roller 1.

Two squared surfaces 12*a*, 12*b*, are machined on the circumferential surface of the support element 9 and are situated in diametrically opposite positions in the part of the element 9 comprised between the roller 1 head and the collar 7.

In the surface of the cavity 6, facing the squared surfaces 12*a*, 12*b*, there is made a recess 13, inside which a parallelepiped block 27 is introduced.

The operation of the above described locking device appears evident from the FIG. 2.

If the roller 1 rotates in the curtain unrolling direction S, nothing obstacles its rotation with respect to the motionless element 9, due to the fact that the squared surfaces, acting as inclined planes, push the block 27 inside the recess 13, each time the latter passes nearby.

Rotation of the roller 1 in the opposite direction, the curtain rolling direction R, is generally prevented, since the block 27 remains in abutment against the two walls, square with each other, of the squared surfaces, which is in the upper position and the lower edge of the recess 13.

Nevertheless, if the rotation of the roller 1 in the rolling direction R is rapid enough, the block 27 does not manage to leave the recess 13 and block the roller 1, due to combined effect of the block 27 inertia and the centrifugal force acting thereon.

The above described solution, although rather efficient and simple to realise, presents a drawback deriving from the fact that it is practically impossible to make more than two squared surfaces 12*a*, 12*b* in the support element 9.

This results in the fact that for each complete rotation of the roller 1, there are only two possible positions, in which it is blocked, and therefore also only two positions, in which the curtain can be blocked.

This excludes a precise positioning of the curtain.

This is not very important when the curtain must be fastened in a completely open or in an intermediate position, but it becomes so, when a closed position of the curtain is desired.

In fact, this position usually does not coincide with one of the possible locking positions, therefore it is almost sure that there will be an air-hole below the lower edge of the curtain, which in case of a mosquito curtain cannot be acceptable.

From the U.S. Pat. No. 1,841,384 there is known a spring-less shade roller which includes a mechanism for controlling rotation of the roller in opposite directions.

The mechanism includes a stationary support and a member rotatably mounted thereon, with a cylindrical brake surface. The support has a resilient brake member made from a sheet metal strip. The brake strip has one end anchored to the support while its extension frictionally engages the cylindrical brake surface of the rotatable member. When the member is rotated in one direction, frictional resistance is increase, and when the member is rotated in the opposite direction, frictional resistance is decreased.

SUMMARY OF THE INVENTION

The object of the present invention is to propose a device for locking awnings, curtains, and the like, that can guarantee their locking in any angular position of the roller, thus allowing complete closing.

Another object of the present invention is to propose a locking device, which is also extremely simple, reliable and cheap to produce.

The above mentioned objects are obtained by an assembly which includes a hollow roller, on which, and from which one curtain, such as window curtains, awnings and the like, is rolled up and unrolled, the assembly also including a device for locking the curtain in a desired position, comprising a support with a cavity made therein, integrally coupled with the roller; inside its cavity, the support accommodates coaxially and rotatably at least one locking element which includes friction means which elastically rub on the support so as to hinder its free rotation by friction action of a predetermined entity, sufficient to prevent rotation thereof when the curtain is not subjected to any external pull action.

BRIEF DESCRIPTION OF THE DRAWINGS

The characteristic features of the invention will be pointed out in the following description, with particular reference to the enclosed drawings, in which:

FIG. 1 is a section view of a prior art head of an apparatus containing a locking means, FIG. 2 is section view taken along the line 2—2 of FIG. 1;

BEST MODE OF CARRYING OUT THE INVENTION

Figure 3:
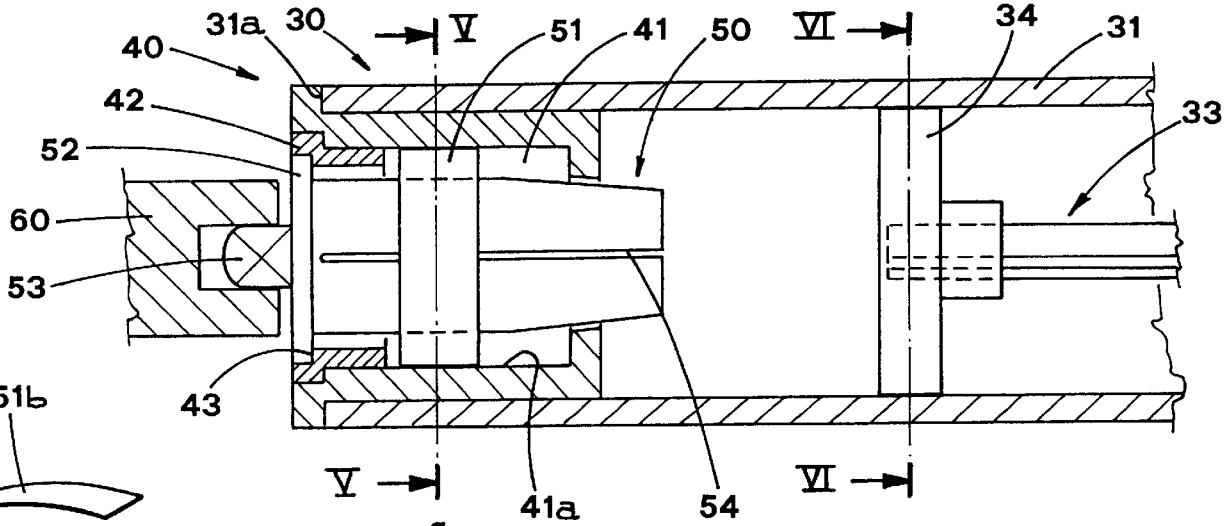
FIG. 3 is a lateral section view of a roller carrying a curtain, provided with a locking device being the subject of the present invention.
Figure 6:
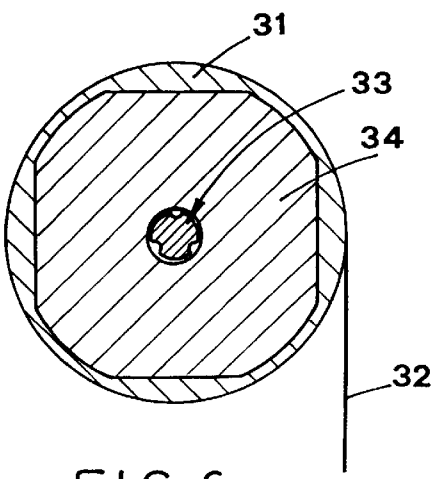
FIG. 6 is a section view taken along the line VI—VI of FIG. 3.
Figure 5:
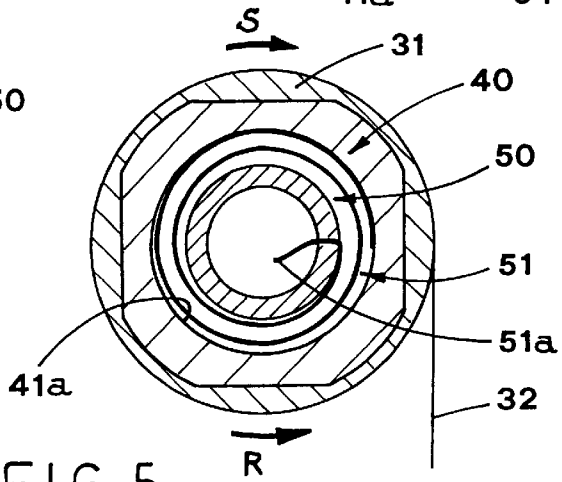
FIG. 5 is a section view taken along the line V—V of FIG. 3.
Figure 4:
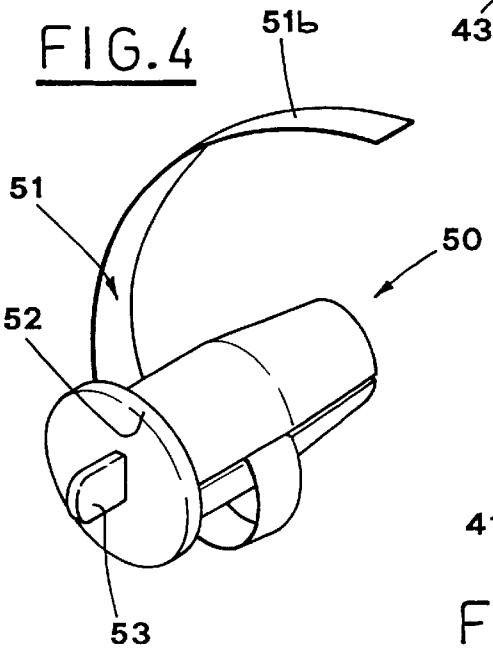
FIG. 4 is a prospective view of the locking element of the aforementioned device.

With reference to the above mentioned figures, numeral 30 indicates an assembly for unrolling and rolling the curtain 32, partially illustrated in section relevant for the present description.

This assembly includes a hollow roller 31, on which the curtain 32 is rolled up.

This roller 31 is rotated, in a known way, with respect to a shaft 33 coaxial therewith, either in the curtain 32 unrolling direction S or in the opposite direction R, in which the curtain 32 rolls up.

The shaft 33 is supported, in a known way, by a suitable spacer 34 situated at the front of the shaft 33 and near and end 31*a* of the roller 31.

The opposite end of the shaft 33 is fastened, in a known and now shown way, to a stationary structure, external with respect to the device 30 for rolling and unrolling the curtain 32.

The locking device, being the subject of the present invention, is situated near this end 31*a*, externally with respect to the aforementioned spacer 34. It includes a support 40, substantially tubular, with a cavity 41 made therein.

The external diameter of the support 40 is equal to the internal diameter of the roller 31, so that the support is snug fit into the end 31*a* of the roller 31 and fixed thereto due to interference. It can be removed from the roller 31 for e.g. maintenance operations.

A ring 42, preferably made of material with low friction, having an external abutment surface 43, is fastened to the wall 41*a* of the cavity 41, in proximity of the external end 40*a* of the support 40.

The support 40 support rotatably, inside its cavity 41, a locking element 50, substantially of cylindrical shape and arranged coaxially with the support 40.

In the region of its external end, this locking element 50 features a disc 52 having a diameter bigger than the diameter of the body of the locking element 50 so as to perfectly enter a recess of the abutment surface 43 of the ring 42.

A tang 43, made in the external face of the disc 52, is restrained in a stationary structure 60 so as to keep the locking element 50 immovable.

The locking element 50 has a longitudinal groove 54 extending to the internal extremity of the locking element 50.

The locking element 50 is also equipped with friction means, which rub elastically on the support 40 so as to hinder its free rotation by friction action of a predetermined effect, sufficient to impede this free rotation if the curtain 32 is not subjected to any external pull.

The above mentioned friction means 51 are made of a band of elastic material, with an internal terminal portion 51*a* inserted in the groove 54 of the locking element 50 and rolled spiral-like thereon.

This band is pre-loaded before the locking element 50 is introduced in the cavity 41.

Due to the elastic reaction of the band 51, its external terminal portion 51*b* engages, with friction, the wall 41*a* of the cavity 41.

Operation of the locking device will be now described, beginning from the condition in which the curtain 32 is completely rolled up on the roller 31.

Generally, in this situation, the roller 31 is not subjected to any pull section which impose rotation.

The elastic reaction of the band 51 acts on the support 40, increasing the position stability of the roller 31.

When the curtain 32 is unrolled, a pull action is performed thereon which tends to impose a rotation to the roller 31 in the direction S.

This makes the wall 41*a* of the cavity 41 slide on the external terminal portion 51*b* of the band 51, in the same direction as the band loading direction, and thus, its diameter reduction direction.

Therefore, a weak friction is obtained on the curtain 32 movement, whose amount depends on the rigidity and elasticity of the band 51.

If the action on the band 32 is interrupted, the elastic re-wind means would tend to roll it up again, overcoming the weight of this part of the curtain which is already unrolled and imposing to the roller 31 a rotation in direction R.

In its turn, this rotation tends to make the wall 41*a* to slide on the external terminal portion 51*b* in a direction which tends to increase the diameter of the band 51, and thus its friction action on the wall 41*a*, up to an amount sufficient to overcome the action of the elastic re-wind means and therefore maintain the curtain 32 perfectly in reached position.

When it is necessary to roll up the curtain, an action is performed thereon, which tends to impose to the roller 31 a rotation in the direction R.

This action sums up with the action of the elastic return means and allows to overcome the braking action of the band 51, thus allowing to roll the curtain 32 up again.

The advantages of the present invention result from the fact that the curtain 32 is locked immediately when an external pull is interrupted, in any position of the curtain.

This allows its complete closing or its precise positioning in intermediate positions.

Other advantages of the present invention derive from the fact that this locking device is extremely simple to produce, reliable and cheap.

It is understood that the subject invention has been described, with reference to the enclosed drawings, as a mere, not limitative example, therefore possible variants resulting from practice and use are protected by the present invention as described above and claimed hereinafter.

What is claimed is:

1. An apparatus for locking a curtain in a selected position comprising:

a hollow roller onto which the curtain is rolled by rotation in a first direction and unrolled by rotation in a second direction, the roller containing elastic rewinding means for biasing the rotation of the roller, a locking device for locking the roller in the selected position, the locking device having a support coupled to the roller, the support having a cavity which receives co-axially and notably at least one locking element, the locking element having elastic friction means, frictionally engaged to the support to hinder free rotation of the roller, said elastic friction means being at least one band of elastic material having a first terminal part fastened to the locking element, the band wound around the locking element, the band engaged frictionally to a cylindrical wall of the cavity such that running said roller in the second curtain unrolling direction stretches the elastic band, reducing the diameter of the band wound around the locking element, thereby reducing friction with the cylindrical wall of the cavity, and turning the roller in the first direction in response to the elastic rewinding means increases the band diameter increasing frictional contact with the cylindrical wall of the cavity such that the bias of the elastic rewinding means is overcome and the roller is locked in the selected unrolled position.

2. The assembly according to claim 1, wherein the support is substantially cylindrical and is removably mounted in an end of the roller.

3. The assembly of claim 1 wherein the locking element has a longitudinal groove, for receiving the first terminal part of the band.

4. The assembly of claim 1 wherein the elastic band is wound around the locking element in a direction corresponding to the first direction of the roller.

* * * * *